US006708619B2

(12) United States Patent
Tota et al.

(10) Patent No.: US 6,708,619 B2
(45) Date of Patent: Mar. 23, 2004

(54) CARTRIDGE SHELL AND CARTRIDGE FOR BLAST HOLES AND METHOD OF USE

(75) Inventors: Edward Tota, Mandurah (AU); Nigel Rogers, Halls Head (AU)

(73) Assignee: Rocktek Limited, Pinjarra (AU)

( * ) Notice: Subject to any disclaimer, the term of this patent is extended or adjusted under 35 U.S.C. 154(b) by 0 days.

(21) Appl. No.: 09/794,202

(22) Filed: Feb. 26, 2001

(65) Prior Publication Data

US 2002/0014176 A1 Feb. 7, 2002

(Under 37 CFR 1.47)

(30) Foreign Application Priority Data

Feb. 29, 2000 (AU) ..... PQ5910

(51) Int. Cl.[7] ..... F42B 3/24; F42B 3/28

(52) U.S. Cl. ..... 102/314; 102/332; 102/493; 102/507

(58) Field of Search ..... 102/493, 507, 102/332, 314

(56) References Cited

U.S. PATENT DOCUMENTS

| | | | | |
|---|---|---|---|---|
| 685,261 A | | 10/1901 | Crane | 102/333 |
| 993,907 A | | 5/1911 | Swingle | 102/333 |
| 1,070,457 A | * | 8/1913 | Gully | 102/507 |
| 1,189,011 A | | 6/1916 | Smith | |
| 1,479,070 A | | 1/1924 | Harris | |
| 1,491,661 A | | 4/1924 | Bayat | |
| 1,616,048 A | | 2/1927 | Holt | |
| 1,896,817 A | | 2/1933 | Heitzman | |

(List continued on next page.)

FOREIGN PATENT DOCUMENTS

| | | |
|---|---|---|
| AU | 8546/22 | 8/1922 |
| AU | 19834/24 | 9/1924 |
| AU | 100512 | 3/1933 |
| AU | 102008 | 12/1933 |
| AU | 20577/34 | 12/1934 |
| AU | 20831/35 | 1/1935 |
| AU | 21197/35 | 2/1935 |
| AU | 21648/35 | 3/1935 |

(List continued on next page.)

OTHER PUBLICATIONS

U.S. patent application Ser. No. 09/868,155, Micke et al., filed Jun. 14, 2001.

AECI Explosives & Chemicals Ltd., "Explosives Today," Series 2, No. 7, Mar. 1977.

Atlas Copco; "We have found the hole"; Boltec Series product brochure; 8 pages.

Boart Longyear Diamond Products, "Boulder Buster: The Choice of Professionals," at http://www.themark.co.za/hh/diy/10459a.htm (1/5/7).

Olson et al., "ARPAA–Bureau of Mines Rock Mechanics and Rapid Excavation Program, A Research Project Summary", United States Department of the Interior, pp 1–191 (BuMines IC 8674) BMIC 1975.

Swartklip Products: A Division of DENEL, "Hydro–fracturing, Rock Breaking Technology," South African Institute of Mining and Metallurgy Joint Colloquium (Jul. 19, 1998).

U.S. patent application Ser. No. 09/794,202, Tota, filed Feb. 26, 2001.

(List continued on next page.)

*Primary Examiner*—Peter A. Nelson
(74) *Attorney, Agent, or Firm*—Sheridan Ross P.C.

(57) ABSTRACT

A cartridge shell 10 comprises a main body 12 defining a volume 14 for holding energetic material. The main body 12 has a first end 16 for location adjacent a toe 48 of a hole 46 and a second end 18 directed to the collar 50 of hole 46. The second end 18 is tapered to reduce in transverse area away from the first end to form a point or wedge-like member 20.

40 Claims, 4 Drawing Sheets

U.S. PATENT DOCUMENTS

| | | | | | |
|---|---|---|---|---|---|
| 2,007,568 | A | | 7/1935 | Heitzman | 102/11 |
| 2,281,103 | A | | 4/1942 | MacDonald | 102/4 |
| 2,296,504 | A | | 9/1942 | Crater | 102/30 |
| 2,725,821 | A | | 12/1955 | Coleman | 102/22 |
| 2,759,417 | A | | 8/1956 | O'Neill | 102/20 |
| 2,799,488 | A | | 7/1957 | Mandt | 262/9 |
| 2,812,712 | A | | 11/1957 | Ashurst | 102/30 |
| 2,980,019 | A | | 4/1961 | Noddin | 102/28 |
| 3,003,419 | A | | 10/1961 | Fite | 102/86.5 |
| 3,055,648 | A | | 9/1962 | Lawrence et al. | 262/12 |
| 3,091,177 | A | | 5/1963 | Grebe | 102/22 |
| 3,134,329 | A | | 5/1964 | Zeman | 102/28 |
| 3,134,437 | A | | 5/1964 | Karpovich | 166/42 |
| 3,144,827 | A | | 8/1964 | Boutwell | 102/39 |
| 3,264,990 | A | | 8/1966 | Betts | 102/28 |
| 3,264,991 | A | | 8/1966 | Betts et al. | 102/28 |
| 3,272,127 | A | | 9/1966 | Betts et al. | 102/70.2 |
| 3,307,445 | A | | 3/1967 | Stadler et al. | 86/20 |
| 3,313,234 | A | | 4/1967 | Mohaupt | 102/20 |
| 3,426,685 | A | * | 2/1969 | Stubbs | 102/507 |
| 3,604,355 | A | | 9/1971 | Greenlees | 102/39 |
| 3,618,520 | A | | 11/1971 | Hamasaki et al. | 103/23 |
| 3,623,771 | A | | 11/1971 | Sosnowicz et al. | 299/12 |
| 3,640,223 | A | | 2/1972 | Olsson | 102/28 |
| 3,721,471 | A | | 3/1973 | Bergmann et al. | 299/55 |
| 3,837,280 | A | | 9/1974 | Lewer | 102/30 |
| 3,945,319 | A | | 3/1976 | Meagher | 102/22 |
| 3,960,082 | A | | 6/1976 | Sloevsky et al. | 102/22 |
| 3,999,484 | A | | 12/1976 | Evans | 102/28 |
| 4,007,783 | A | | 2/1977 | Amancharla et al. | 166/135 |
| 4,040,355 | A | | 8/1977 | Hopler, Jr. | 102/22 |
| 4,074,629 | A | | 2/1978 | Colgate | 102/23 |
| 4,099,784 | A | | 7/1978 | Cooper | 299/10 |
| 4,140,188 | A | | 2/1979 | Vann | 175/4.51 |
| 4,141,592 | A | | 2/1979 | Lavon | 299/16 |
| 4,149,604 | A | | 4/1979 | Lockwood et al. | 175/57 |
| 4,165,690 | A | | 8/1979 | Abrahams | 102/22 |
| 4,195,885 | A | | 4/1980 | Lavon | 299/1 |
| 4,204,715 | A | | 5/1980 | Lavon | 299/16 |
| 4,208,966 | A | | 6/1980 | Hart | 102/20 |
| 4,315,463 | A | | 2/1982 | Arcand | 102/303 |
| 4,327,643 | A | * | 5/1982 | Lasheras Barrios | 102/493 |
| 4,419,935 | A | | 12/1983 | Shibukawa | 102/313 |
| 4,470,352 | A | | 9/1984 | Leperre | 102/333 |
| 4,501,199 | A | | 2/1985 | Mashimo et al. | 102/313 |
| 4,508,035 | A | | 4/1985 | Mashimo et al. | 102/313 |
| 4,615,268 | A | | 10/1986 | Nakano et al. | 102/217 |
| 4,669,383 | A | | 6/1987 | Penner | 102/202 |
| 4,685,396 | A | | 8/1987 | Birse et al. | 102/206 |
| 4,754,705 | A | | 7/1988 | Worsey | 102/333 |
| 4,809,612 | A | | 3/1989 | Ballreich et al. | 102/466 |
| 4,869,171 | A | | 9/1989 | Abouav | 102/215 |
| 4,884,506 | A | | 12/1989 | Guerreri | 102/200 |
| 4,886,126 | A | | 12/1989 | Yates, Jr. | 175/4.54 |
| 4,900,092 | A | | 2/1990 | Van Der Westhuizen et al. | 299/13 |
| 5,000,516 | A | | 3/1991 | Kolle et al. | 299/16 |
| 5,033,390 | A | | 7/1991 | Minert et al. | 102/530 |
| 5,052,301 | A | | 10/1991 | Walker | 102/202.7 |
| 5,069,130 | A | | 12/1991 | Buckley et al. | 102/202 |
| 5,090,321 | A | | 2/1992 | Abouav | 102/200 |
| 5,098,163 | A | | 3/1992 | Young | 299/13 |
| 5,211,224 | A | | 5/1993 | Bouldin | 166/63 |
| 5,247,886 | A | | 9/1993 | Worsey | 102/312 |
| 5,253,586 | A | | 10/1993 | Worsey | 102/313 |
| 5,308,149 | A | | 5/1994 | Watson et al. | 299/13 |
| 5,375,527 | A | | 12/1994 | Nakajima | 102/301 |
| 5,452,661 | A | | 9/1995 | Neff | 102/202.7 |
| 5,474,364 | A | | 12/1995 | Ruzzi et al. | 299/13 |
| 5,482,754 | A | | 1/1996 | Crook | 428/54 |
| 5,551,344 | A | | 9/1996 | Couet et al. | 102/312 |
| 5,564,499 | A | | 10/1996 | Willis et al. | 166/299 |
| 5,573,307 | A | | 11/1996 | Wilkinson et al. | 299/14 |
| 5,576,511 | A | | 11/1996 | Alhamad | 102/303 |
| 5,611,605 | A | | 3/1997 | McCarthy | 299/13 |
| 5,705,768 | A | | 1/1998 | Ey | 103/307 |
| 5,710,390 | A | | 1/1998 | Ofca | 102/275.4 |
| 5,714,712 | A | | 2/1998 | Ewick et al. | 102/311 |
| 5,765,923 | A | | 6/1998 | Watson et al. | 299/13 |
| 5,789,694 | A | | 8/1998 | Mey | 86/20.15 |
| 5,803,550 | A | | 9/1998 | Watson et al. | 299/13 |
| 5,803,551 | A | | 9/1998 | McCarthy | 299/13 |
| 5,874,691 | A | * | 2/1999 | Manole et al. | 102/507 |
| 6,035,784 | A | | 3/2000 | Watson | 102/313 |
| 6,119,574 | A | | 9/2000 | Burkey et al. | 89/36.04 |
| 6,145,933 | A | | 11/2000 | Watson et al. | 299/13 |
| 6,148,730 | A | | 11/2000 | Watson | 102/313 |
| 6,155,172 | A | | 12/2000 | Nakajima | 102/302 |
| 6,213,022 | B1 | * | 4/2001 | Pullum | 102/507 |
| 6,305,292 | B1 | * | 10/2001 | Burczynski et al. | 102/507 |
| 6,321,655 | B1 | | 11/2001 | Tota et al. | 102/302 |
| 6,332,401 | B1 | | 12/2001 | Tota et al. | 102/303 |
| 6,339,992 | B1 | | 1/2002 | Watson | 102/312 |
| 6,347,837 | B1 | | 2/2002 | Watson et al. | 299/13 |
| 6,386,111 | B1 | | 5/2002 | Shann | 102/333 |
| 6,435,096 | B1 | | 8/2002 | Watson | 102/319 |
| 6,457,416 | B1 | | 10/2002 | Micke | 102/473 |

FOREIGN PATENT DOCUMENTS

| | | | |
|---|---|---|---|
| AU | 22195/35 | | 4/1935 |
| AU | 481166 | | 3/1938 |
| AU | 104790 | | 8/1938 |
| AU | 34081/68 | | 8/1969 |
| AU | 71742/74 | | 1/1976 |
| AU | A-39461/85 | | 3/1985 |
| AU | A-73614/87 | | 5/1987 |
| AU | 8546/22 | A | 12/1992 |
| AU | B-33867/93 | | 2/1993 |
| AU | B-41210/93 | | 11/1993 |
| AU | B-30436/92 | | 1/1995 |
| AU | 19834/24 | A | 2/1995 |
| AU | 73576/96 | | 8/1996 |
| AU | 020566 | | 7/2000 |
| AU | 020534 | | 6/2001 |
| DE | 477885 | | 6/1929 |
| DE | 628934 | | 4/1936 |
| DE | 949633 | | 9/1956 |
| DE | 911896 | | 11/1962 |
| EP | 0 108 519 | | 11/1983 |
| EP | 0109067 | | 11/1983 |
| EP | 0 311 025 | | 5/1988 |
| FI | 80948 | | 4/1990 |
| FR | 1039136 | | 10/1953 |
| FR | 1168059 | | 12/1958 |
| GB | 397203 | | 8/1933 |
| GB | 430250 | | 6/1935 |
| GB | 436144 | | 10/1935 |
| GB | 453210 | | 9/1936 |
| GB | 481166 | | 3/1938 |
| GB | 618618 | | 2/1949 |
| GB | 800883 | | 9/1958 |
| GB | 859861 | | 1/1961 |
| GB | 911896 | | 11/1962 |
| GB | 1144446 | | 3/1969 |
| GB | 2209819 | | 5/1989 |
| HU | 171229 | | 6/1978 |
| HU | 166283 | | 9/1978 |
| HU | 178433 | | 12/1983 |
| RU | 2001268 | C1 | 11/1991 |
| RU | 2072091 | | 1/1997 |
| SU | 968-393 | A | 3/1981 |

| | | | |
|---|---|---|---|
| WO | WO 91/02212 | 2/1991 | |
| WO | WO 92/02709 | 2/1992 | |
| WO | WO 95/28551 | 10/1995 | |
| WO | WO 97/06402 | 2/1997 | |
| WO | WO 97/10414 | 3/1997 | |
| WO | WO 97/17588 | 5/1997 | |
| WO | WO 97/21068 | 6/1997 | ..... F42D/1/20 |
| WO | WO 98/20295 | 5/1998 | |
| WO | WO 98/44309 | 10/1998 | |
| WO | WO99/24776 | 5/1999 | |
| WO | WO 99/31457 | 6/1999 | |
| WO | WO 99/61864 | 12/1999 | |
| WO | WO 00/36364 | 6/2000 | |
| ZA | 87/7729 | 12/1987 | |
| ZA | 91/3432 | 7/1991 | |
| ZA | 92/6170 | 8/1992 | |
| ZA | 952646 | 3/1995 | |
| ZA | 970578 | 1/1997 | |

OTHER PUBLICATIONS

U.S. patent application Ser. No. 09/909,493, Gavrilovic, filed Jul. 19, 2001.
U.S. patent application Ser. No. 09/710,497, Watson, filed Nov. 10, 2000.
U.S. patent application Ser. No. 09/173,876, Micke, filed Oct. 16, 1998.
Bulletin from AECI Explosives & Chemicals Ltd., "Explosives Today", Series 2, No. 5, Jan. 1977.
McAdam & Westwater, "Mining Explosives," pp. 12–15.
Bulletin from AECI Explosives & Chemicals Ltd., "Explosives Today", Series 2, No., 46, Jun. 1987.
Bulletin from AECI Explosives & Chemicals Ltd., "Explosives Today", Series 2, No. 36, 2$^{nd}$ Quarter 1984.
AECI Explosives & Chemicals Ltd. Catalogue of Explosives and Accessories.
Young, Watson, & Levien, "Full–Scale Testing of the PCF Rock Excavation Method", Australian Tunnelling Conference, Aug. 1993.
Young & Dick, "Controlled Fracture Techniques for Rapid Excavation—Phase II Final Report", Jun. 16, 1989.
Young, Dick, & Fourney, "Small–charge Cone–fracture Technique for Rapid Excavation", Fragblast 90, Aug. 1990.
Pearson, "Continuous Resue Stoping", Gold Mining on the Witaters Rand, vol. 1, 1946.
Bock, Jagger, & Robinson, "An economic model for gold and platinum mining using selective blast mining", Journal of the South African Institute of Mining and Metallurgy, Mar./Apr. 1998.
Lewis, "Elements of Mining" 1941, Chapter V, pp. 96–103.
Brinkmann, "Blasting Technology in Stoping and Development", Saimm School Feb. 1986.
Bulletin from AECI Explosives & Chemicals Ltd., "Explosives Today", Series 2, No. 45, Mar. 1987.
Peele & Church, "Mining Engineer's Handbook" 1918, pp. 4–19–4–25.
Swartklip Products, "Hydro–fracturing, Rock Breaking Technology", Jul. 29, 1998.
RocKracker from RockTek USA Ltd.; *Shooting Oversize Couldn't be Easier*!.
RocKracker; *The Simple Rockbreaking System from RockTek USA Ltd.*.
daveyfire inc.; *Product Reference System*; 1–3.
daveyfire inc.; *N Series Fusehead*; 1–7.
daveyfire inc; *Home Product Reference System Initiation Devices*; 1–4.
Persson et al.; 1993; *Rock Blasting and Explosives Engineering*; 56 and 400–401.

* cited by examiner

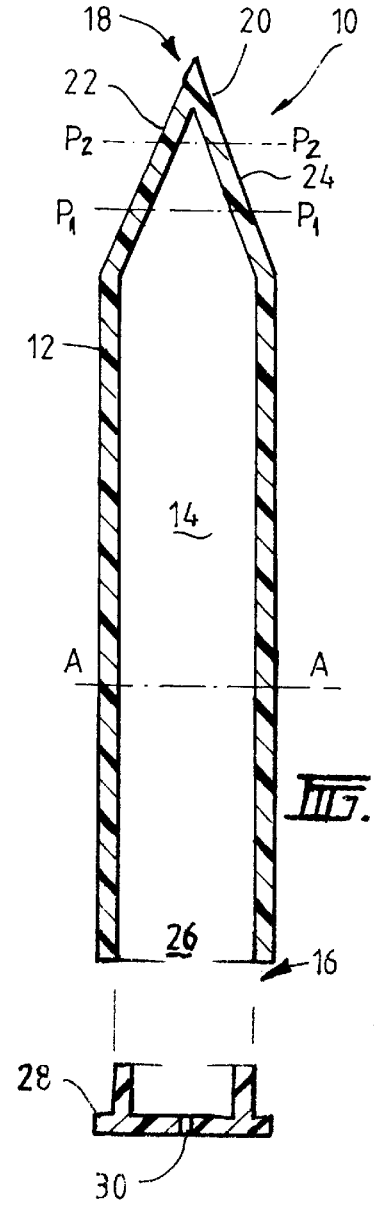
FIG. 1.
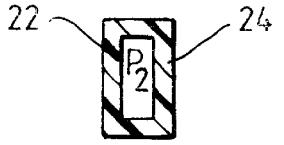
FIG. 5.
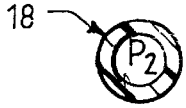
FIG. 7.
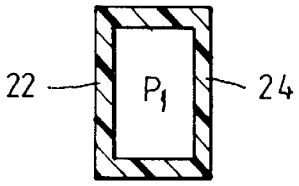
FIG. 4.
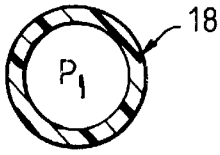
FIG. 6.
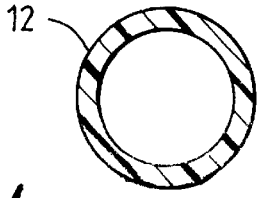
FIG. 3.
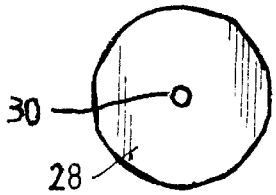
FIG. 2.
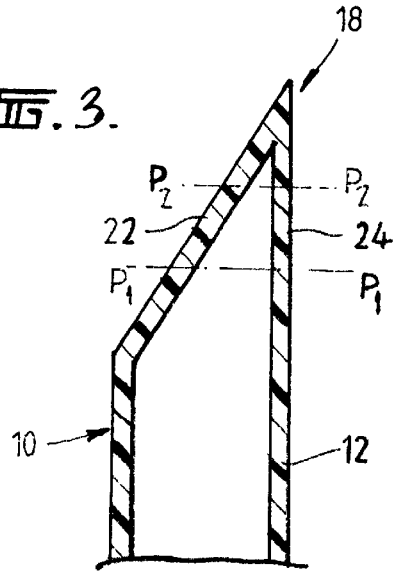
FIG. 8.
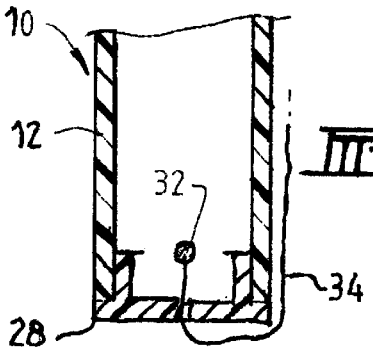
FIG. 9.
FIG. 10.
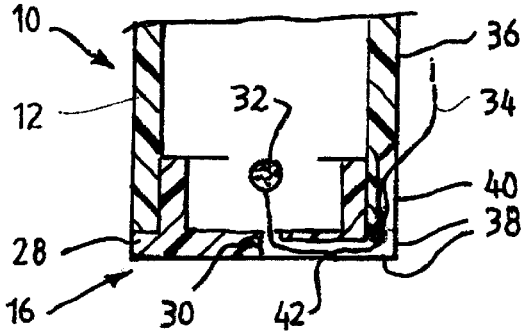

CARTRIDGE SHELL AND CARTRIDGE FOR BLAST HOLES AND METHOD OF USE

This application claims foreign priority benefits under 35 U.S.C. §119 from Australian Patent Application Serial No. PQ5910 filed Feb. 29, 2000.

FIELD OF THE INVENTION

The present invention relates to a cartridge shell and a corresponding cartridge for blast holes for the purpose of fracturing hard materials. The invention further relates to a method of use of such a cartridge and in particular a method of charging blast holes with the cartridge.

BACKGROUND OF THE INVENTION

A typical cartridge shell for a blast hole is in the form of a cylindrical tube closed at both ends. Some cartridges may contain only an energetic substance while others may contain both an energetic substance and an initiator. The cartridge will be inserted to reside near the toe of a blast hole drilled or otherwise formed in a rock or other hard material to be fractured. The hole may then be stemmed with a particulate stemming material. When the energetic material in the cartridge is initiated there is a rapid generation of gas and thus a rapid build up of gas pressure near the toe of the hole. Provided that the gas generated is contained for a short period of time the resulting gas pressure may cause fractures to be propagated from the hole through the hard material.

The efficiency and effectiveness of this process is largely determined by factors such as the provision and quality of a gas seal formed on the side of the cartridge nearest the collar of the blast hole and the ability to hold the seal in position. Clearly if the seal is poor, gas will escape around the seal thereby reducing gas pressure as well as the rate of gas pressure increase. Further, the escaping gas has adverse effects in terms of ejecting stemming from the blast hole, generation of recoil and producing flyrock. However, even if the seal is one of high integrity, if the seal is not held firmly in place and is able to be pushed back toward the collar of the hole then the physical volume of the confined space within the hole in which the gas acts increases, thereby decreasing the gas pressure.

SUMMARY OF THE INVENTION

It is an object of the present invention to provide a cartridge shell and associated cartridge that in use may assist in alleviating the above noted deficiencies. It is a further object of the present invention to provide a method of charging a blast hole with such a cartridge.

According to a first aspect of the present invention there is provided a cartridge shell for use in fracturing hard materials, said shell including at least: a main body defining a volume for holding an energetic material, the body having a first and second opposite ends, the first end being generally planar and the second end being tapered to form a point or wedge-like member directed away from the first end.

Preferably the main body includes a line or zone of weakness adjacent to the first end.

Preferably the cartridge shell includes a closure device at the first end said closure device being provided with, or in conjunction with the main body defining, the line or zone of weakness.

Preferably the main body is provided with an opening at the first end and the closure device comprises a cap for closing said opening.

In one embodiment, the cartridge shell further includes an aperture at the first end through which an initiator lead passes. Preferably the aperture is formed in the closure device.

Advantageously, the cartridge shell includes a recess passageway on an outer surface about the first end to seat the initiator lead.

In an alternate embodiment the cartridge shell includes an aperture in or near the second end through which an initiator lead passes. In this embodiment the cartridge shell may include an internal recess or passageway through which the initiator lead extends.

Preferably the second end is provided with two or more inclined surfaces that converge toward each other in the direction from the first end to the second end.

However, in an alternate embodiment, the second end is in the form of a conical frustum.

According to a second aspect of the present invention there is provide a shell for a cartridge for use in breaking and/or fracturing of hard material by the insertion of the cartridge followed by particulate stemming material in a hole and subsequent initiation of the cartridge, the shell including at least a main body defining a volume for holding an energetic material, the body having first and second opposite ends, the second end including a surface for exerting a radial compressive force on the stemming material in use.

According to a further aspect of the invention there is provided a cartridge for use in fracturing a hard material, the cartridge comprising at least:

a cartridge shell in accordance with the first or second aspect of the present invention and a quantity of an energetic material held within the main body of the cartridge shell.

Preferably the cartridge further comprises an initiator disposed within the main body.

Preferably the cartridge further includes an initiator lead connected at one end to the initiator and passing through an aperture in the cartridge shell.

Preferably the energetic material is a propellant.

Preferably the initiator is a non-explosive initiator.

Preferably said cartridge includes a booster for the initiator.

In an alternate embodiment, said cartridge further includes one or more booster cartridges each containing a quantity of energetic material, said one or more booster cartridges connectable in an end to end fashion with said first end of said main body and with each other whereby the total quantity of energetic material contained by the cartridge is varied by connecting one or more booster cartridges to said main body.

Preferably said main body and each of said booster cartridges each contain no more than 10 gm of energetic material.

Preferably each booster cartridge has a first engaging means at a first end and a second complimentary engaging means at a second opposite end whereby the first engaging means of a booster cartridge is engageable with a second engaging means of an adjacent booster cartridge.

Preferably said first engaging means is received inside said second engaging means so that an outer surface of a plurality of connected booster cartridges is of substantially constant outer diameter.

Preferably each booster cartridge includes a substantially cylindrical body of a first outer diameter; an axial extension at said first end forming said first engaging means of a second reduced outer diameter; and, a recess at said second end forming said second engaging means, of an inner diameter less than the outer diameter of the axial extension to enable said first engaging means to fit inside said second engaging means.

Preferably said first engaging means and said second engaging means are relatively configured relative to each other to provide an interference fit therebetween.

Preferably said axial extension includes a plurality of circumferential, axially spaced apart ribs.

In an alternate embodiment said first and second engaging means are threadingly engageable with each other.

Preferably said booster cartridges are closed at opposite ends by respective webs, where said webs are combustible, or frangible, or both combustible and frangible.

According to a further aspect of the present invention there is provided a cartridge shell including at least;

a primary shell having a main body defining a volume for holding an energetic material, the main body having first and second opposite ends, the second end being tapered to reduce in transverse area away from said first end; and, one or more secondary shells, each secondary shell having a generally cylindrical body for holding a volume of energetic material, said one or more secondary shells releasably connected in an end to end manner with said first end of said primary shell and with each other.

According to a further aspect of the invention there is provided a method of charging and stemming a blast hole in a hard material, the blast hole having a collar adjacent a free face of the hard material and a toe at the opposite end of the hole, the method including at least the steps of:

inserting a cartridge in accordance with the second aspect of the present invention into the blast hole with the second end of the cartridge facing the collar of the blast hole;

providing a particulate stemming material comprising a mixture of a dry binding agent, fines and coarse material;

depositing said stemming material into said hole;

mechanically holding the stemming in the hole.

Preferably said depositing step includes blowing said stemming material into said hole.

Preferably said method further includes the steps of blowing the stemming material into the hole to a level below the free surface of the hard material; inserting a stemming bar into the blast hole to bear at one end on the stemming material with an opposite end of the stemming bar extending from the free face of the hard material; and, mechanical holding said opposite end of the stemming bar.

Preferably said method includes the step of forming one end of the stemming bar with a point or wedge-like member directed away from the opposite end of the stemming bar.

Preferably said method further comprises the step of injecting a volume of a liquid or gel into the blast hole after insertion of the cartridge to fill any space between an outer surface of the cartridge and the hole and provide a liquid or gel layer between the second end of the cartridge and the particulate stemming material.

Preferably when the method is used in an underground mine having a wall in which the blast hole is formed and an opposite wall, the step of mechanically holding the stemming in the hole includes the step of operating a jack so that one end of the jack bears on the wall over the blast hole while an opposite end of the jack bears on the opposite wall.

According to a further aspect of the invention there is provided a stemming material for use in charging a blast hole the stemming material comprising a mixture of a dry binding agent, fines, and coarse material.

Preferably the binding agent is one of the group consisting of fly ash; smelter waste material; or other fines containing cementitious material.

BRIEF DESCRIPTION OF THE DRAWINGS

Embodiments of the present invention will now be described by way of example only with reference to the accompanying drawings in which:

FIG. 1 is an exploded sectional view of a cartridge shell in accordance with the present invention;

FIG. 2 is a bottom view of an end cap incorporated in the cartridge shell;

FIG. 3 is a view of section A—A of FIG. 1;

FIG. 4 is a view of section P1—P1 of FIG. 1;

FIG. 5 is a view of section P2—P2 of FIG. 1;

FIG. 6 is a view of section P1—P1 of a second embodiment of the cartridge shell;

FIG. 7 is a view of section P2—P2 of the second embodiment of the cartridge shell;

FIG. 8 is a section view of an upper end of a third embodiment of the cartridge shell;

FIG. 9 is a section view of a bottom part of the cartridge shell of FIG. 1 showing the layout of an initiator and initiator lead;

FIG. 10 is a section view of a fourth embodiment of the cartridge shell;

DETAILED DESCRIPTION OF THE PREFERRED EMBODIMENTS

Figure 11:
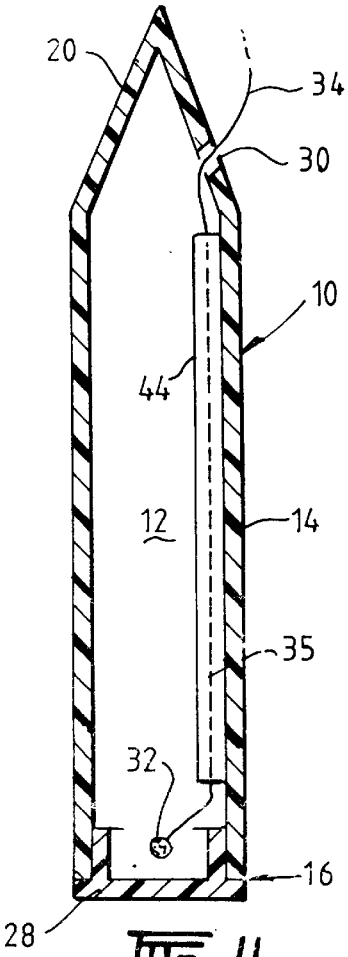
FIG. 11 is a section view of a bottom part of a fifth embodiment of the cartridge shell.

FIGS. 1–5 depict a first embodiment of the cartridge shell 10. The cartridge shell comprises a main body 12 defining a volume 14 for holding an energetic material (not shown). The main body 12 has a first end 16 and an opposite second end 18. The first end 16 is generally planar and in effect forms a planar base for the shell 10. The second end 18 however is tapered to form a point or wedge-like member 20.

The tapering of the second end 18 is configured so that an area of the second end 18 measured in a plane transverse to a longitudinal axis of the main body 12 reduces in a direction to the first end 16 to the second end 18. Thus, with reference to FIGS. 4 and 5, the area of the second end 18 in plane P2 is reduced in comparison to the area measured in plane P1.

The second end 18 can take one of a number of different specific shapes. In FIGS. 1, 4 and 5 it is seen that the second 18 is in the form of two inclined surfaces 22 and 24 that converge toward each other. However, in an alternate embodiment the second end 18 can be in the form of a conical frustum. This is depicted in FIGS. 6 and 7 which illustrate a transverse section of the second end 18 through planes P1 and P2 respectively. In yet a further embodiment depicted in FIG. 8, the second end 18 is in the form of a chisel point. Of course other shapes are possible such as, but not limited to, three, four or five sided prisms.

Ideally the main body 12 and the second end 18 would be formed integrally and from a plastics material. However it is possible for the second end 18 to be made separately from the main body 12 and if so, the two components can then be attached together. The main body 12 will conveniently be in the form of a cylindrical tube as depicted in FIG. 3 showing section A—A of FIG. 1.

Main body 12 has an opening 26 at the first end to allow filling of the shell 10 with an energetic material. A closure in the form of a cap 28 is provided for insertion into and closure of the opening 26. The cap 28 is press/interference fitted into the opening 26. This forms a line or zone of weakness at the first end 16.

An aperture 30 is formed centrally through the cap 28 to allow an initiator such as an electric match 32 (see FIG. 9) to be pushed into the main body 12. A lead 34 from the match 32 passes through aperture 30 for coupling with an electric power source.

In an alternate embodiment depicted in FIG. 10 the outer surface 36 of the shell 10 near the first end 16 is provided with a recess 38 for seating the initiator lead 34. The recess includes a first length 40 provided on the main body 12 and a second length 42 provided in the cap 28. The cap 28 is orientated when inserted into the main body 12 so that the lengths 40 and 42 of the recess 38 are in alignment. When the electric match 32 is inserted through the aperture 30 the lead 34 can be seated in the recess 38 to provide it with some protection from accidental damage or cutting when the shell 10 is inserted into a blast hole. In a further variation the length 40 of the recess 38 can be extended along the main body 12 to at least a point where the wedge-like member 20 commences.

In a further variation depicted in FIG. 11, the aperture 30 is placed in the point or wedge-like member 20 rather than in cap 28. In this embodiment the shell 10 can also be provided with an internal passageway 35 through which the lead 34 passes to deposit the initiator 32 near the first end 16 inside the main body 12.

Figure 12:
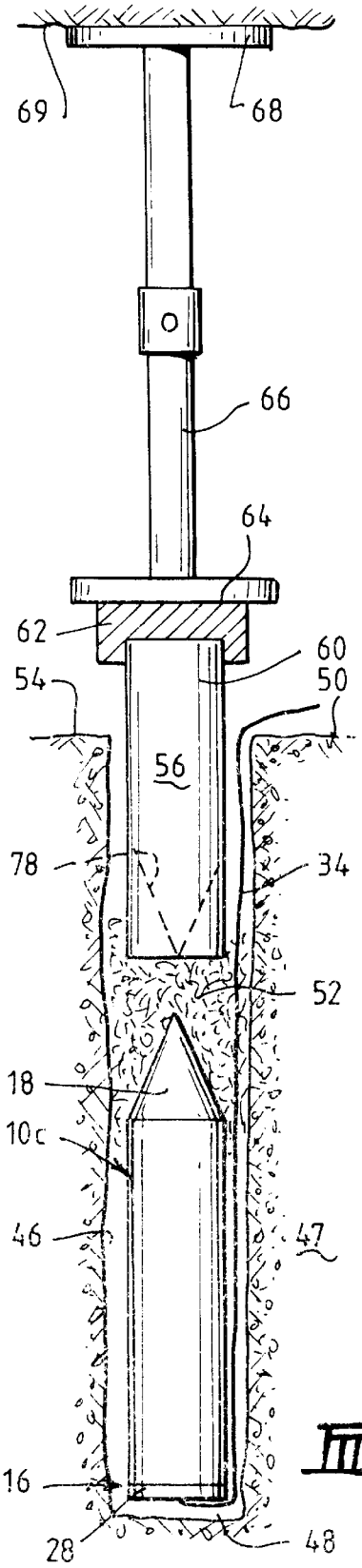
FIG. 12 depicts one method of use of a cartridge made from a cartridge shell in accordance with embodiments of this invention.

FIG. 12 illustrates one method of use of the shell 10. The volume 14 of the shell 10 is filled with an energetic substance such as a propellant to form a cartridge 10*c*. The cartridge 10*c* is inserted into a blast hole 46 formed in hard material 47 with first end 16 first so that the first end 16 is adjacent a toe 48 of the hole. Accordingly the second end 18 faces or is directed toward a collar 50 of the hole. Next, a quantity of particulate stemming material 52 is placed in the hole 46. Typically this will be done by blowing. The stemming material 52 is blown into the hole 46 to a level below the free face 54 of the hard material 47 in which the hole 46 is formed. The stemming 52 is then mechanically held in the hole 46.

In the embodiment of FIG. 12 the mechanical holding is achieved by inserting a stemming bar 56 into the hole 46 so that one end 58 of the stemming bar rests on the stemming 52 and an opposite end 60 of the stemming bar extends from the free face 54. A cup 62 is placed over and cradles end 60. An opposite side of the cup 64 is formed with a planar base and supports an acrow prop 66. The acrow prop 66 is extended in length or otherwise jacked so that its opposite end 68 abuts a wall 69 disposed opposite the free face 54.

By connecting lead 34 with an electrical power source, the initiator 32 generates a high temperature flame to initiate the propellant or other energetic material within the cartridge 10*c*. The gas generated upon initiation initially bursts through the main body 12 about the line of weakness formed by the coupling of the cap 28 to the main body 12. The increase in gas pressure can tend to force the cartridge 10*c* toward the collar 50 of the hole 46. As this occurs, the point or wedge-like member 20 acts on the stemming 52 to increase the radial compressive force on the stemming material in an annular-like region between the peripheral of the second end 18 and the adjacent portion of the surface of hole 46 thereby increasing the sealing effect of the stemming material 52. The stemming material 52 is prevented from blowing out of the hole 46 by action of the mechanical retention provided by the stemming bar 56 and acrow prop 66.

The sealing effect of the stemming material 52 is enhanced by forming the stemming material 52 from a mixture of a dry binding agent, fines, and coarse material. It has been found that fly ash is a particularly beneficial binding agent and the mixture containing fly ash has a tendency to set when blown under pressure into the hole 46. The binding agent and fines comprises particulate solids of mesh size less than about 1 mm. The coarse material within the stemming aggregate contains particles of mesh size up to about 6 mm. Binding agents other than fly ash can be used in the stemming material such as waste products from smelters, or fines containing cementitious material.

Figure 13:
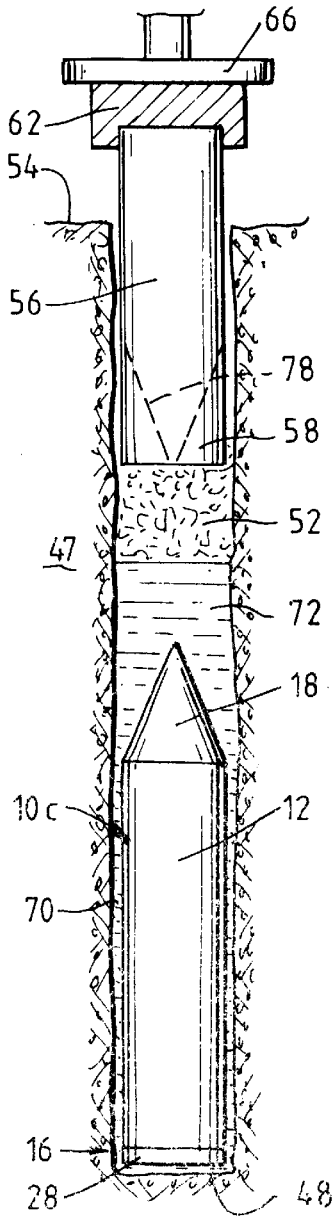
FIG. 13 illustrates the second method of use of a cartridge incorporating the cartridge shell in accordance with embodiments of this invention.

In an alternate method for stemming the hole 46, after the cartridge 10*c* has been inserted into the hole a volume of a liquid or gel 70 is inserted into the hole 46 to fill any space between the outer surface of the cartridge 10*c* and the surface of the hole 46 and provide a liquid or gel layer 72 between the particulate stemming material 52 and the cartridge 10*c*. The gel 70 assists in sealing the hole 46 to prevent the escape of gases upon initiation of the energetic material held within the cartridge 10*c*. In all other respects, the method depicted in FIG. 13 is the same as that depicted in FIG. 12.

The use of the stemming material 52 either by itself or in conjunction with the liquid/gel 70 provides a seal of high integrity that substantially limits the escape of gas. The mechanical retention of the stemming by use, in these embodiments, of the stemming bar 56 and the acrow prop 66 prevents the stemming 52 being displaced toward the collar of the hole 50 thus maintaining relative constant the volume of the hole 46 within which the gas operates.

Figure 14:
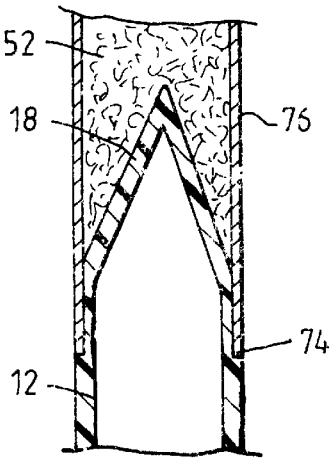
FIG. 14 illustrates a further embodiment of a cartridge shell/cartridge.
Figure 15:
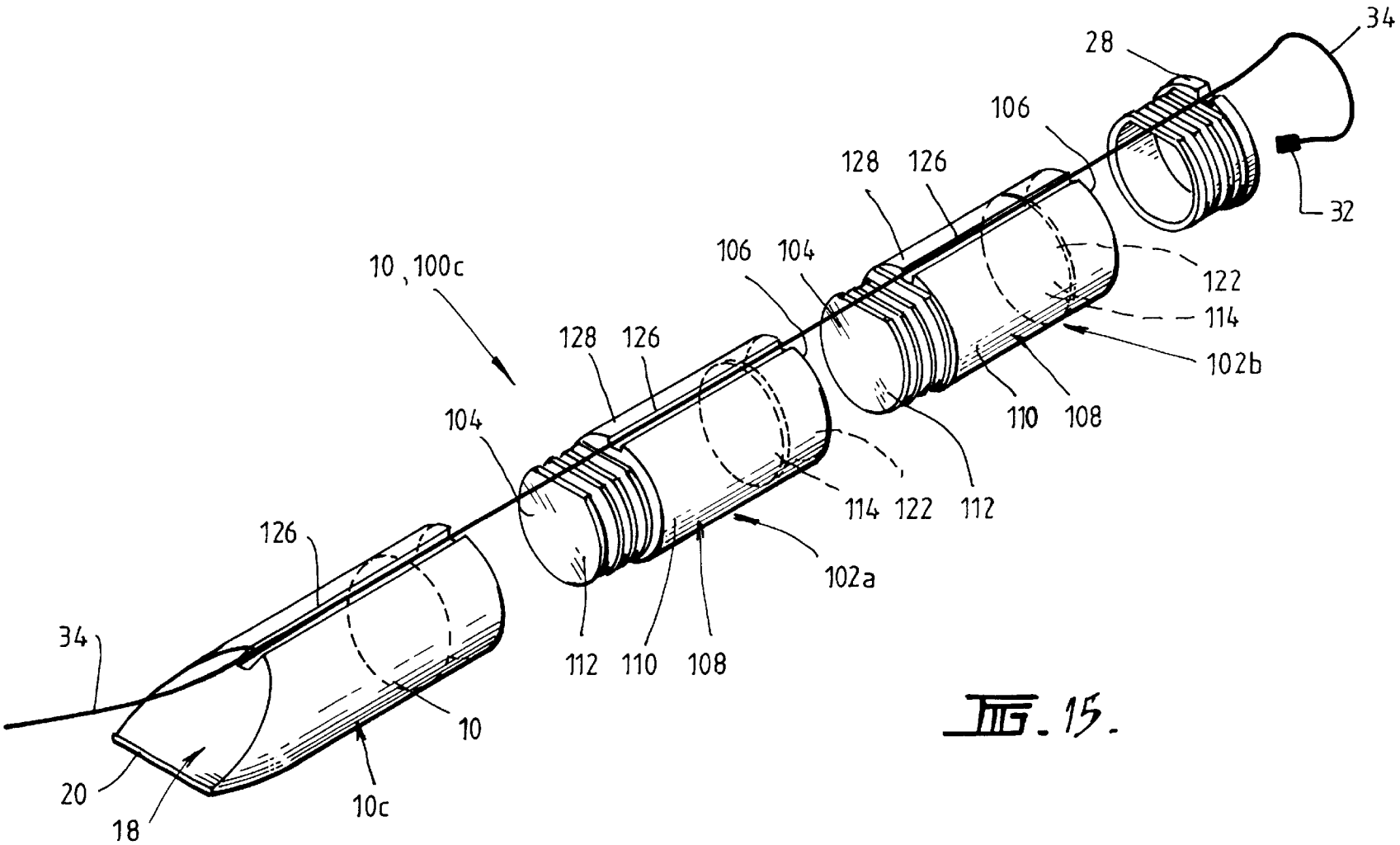
FIG. 15 is a sectional exploded view of a secondary shell depicted as FIG. 14.

FIGS. 14 and 15 depict a shell 10' and corresponding cartridge 100*c* in accordance with a further embodiment of the present invention. The cartridge 100*c* is in effect a stackable cartridge comprising a shell 10 in substantial accordance with that depicted in FIG. 1, although with a body 12 of shorter length, and two secondary cartridges 102*a* and 102*b* (hereinafter referred to in general as "secondary cartridges 102"). Different embodiments of the cartridge 100*c* can include either a single secondary cartridge 102 or more than two secondary cartridges 102. The shell 10, when containing energetic material constitutes primary cartridge 10*c*.

Each secondary cartridge 102 contains a quantity of energetic material (not shown) and is formed so as to be connectable in an end to end fashion with the first end 16 of the main body 12 and with each other. In this way, the total quantity of energetic material contained by the cartridge 100*c* can be varied by connecting one or more secondary cartridges 102 to the main body 12. This has substantial ramifications in terms of transportation and storage of energetic materials. For example, by forming the body 12 and the secondary cartridges 102 to contain no more than 10 gm of energetic material, a 50 gm cartridge can be constructed by connecting together a single body 12 and four secondary cartridges 102. However the individual body 12 and cartridges 102 can be transported separately as "10 gm cartridges" potentially under less stringent requirements than a single 50 gm cartridge under the UN Safety Classification regarding the transportation of such goods.

Each secondary cartridge 102 has a first engaging means 104 at one end and a second complimentary engaging means 106 at a second opposite end. This enables the first engaging means of one secondary cartridge (e.g. engaging means 104 of secondary cartridge 102*b*) to engage with the second engaging means of an adjacent secondary cartridge (e.g. second engaging means 106 of booster cartridge 102*a*).

Each secondary cartridge 102 has an outer shell 108 which includes a substantially cylindrical body 110 with the first engaging means 104 being in the form of an axial extension 112 at the first end of the cartridge 102. The extension 112 is formed with an outer diameter less than the outer diameter of the cylindrical body 110. The second engaging means 106 is in the form of a recess 114 formed at an opposite end of the cylindrical body 110.

The outer surface of the axial extension 112 is circumscribed by two axially spaced protrusions 116. The protrusions 116 have a saw tooth like profile, as can be seen most clearly in FIG. 15.

The inside surface of each recess 114 is likewise circumscribed by two axially spaced apart ridges or ribs 118.

As is further apparent from FIG. 15, the inner diameter of the recess 114 is greater than the inner diameter of the cylindrical body portion 110 of the shell 108 creating an annular seat 120 therebetween. The recess 114 is created by inserting a closure disc 122 into the end of the shell 108 to sit against the annular seat 120. A further ridge or rib 124 is formed about the inside surface of the recess 114 at locations spaced from the annular seat 120 by a distance approximately equal to the thickness of the periphery of the disc 122. Further, the ridge 124 and disc 122 are dimensionally related so that the ridge 124 sits behind the disc 122 and effectively holds the disc 124 against the seat 120. The disc 122 is made from a combustible material such as plastics, paper or cardboard.

When assembling the cartridge 100*c*, the shells 108 are held in a vertical disposition with axial extension 112 down, and energetic material poured in through recess 114 to maximum level up to the annular seat 120. The closure disc 122 is then inserted past ridges 118 and 124 to be held against the annular seat 120.

To connect two secondary cartridges 102 together, the axial extension 112 of one cartridge is pushed into the recess 124 of an adjacent cartridge. During this process, the protrusions 112 click past the ridges 118 until the forward end of the extension bears against the disc 120. In this position, the ridges 118 are effectively seated with a snap fit behind respective protrusions 116. The end most secondary cartridge 102*b* of the cartridge 100*c* is closed with an end cap 28 identical to that described in relation to FIGS. 1 and 10.

A longitudinal groove 126 is formed along the outside surface of cartridge 100*c*/shell 10' having a separate length on each of shell 10 and shells 108 of cartridges 102*a* and 102*b*. The groove 126 seats lead 34 provided with an electric match 32 which is inserted into the end cap 28. Prior to the insertion of the end cap 28, a hole is pierced through the disc 122 in cartridge 102*b* through which the match 32 can be inserted.

In order to assist in the alignment of the separate lengths of groove 126 on both the shell 10 and shells 108, the outside surface of each extension 112 and the inside surface of each recess 114 is provided with a flat. The flat is depicted as item 128 on the axial extensions 112 in FIG. 14. Corresponding flats (not shown) are provided on the inside surface of each recess 114.

In order to allow insertion of the closure disc 122 into the recess 114, the disc 122 is also provided with a flat 130.

To facilitate coupling of the primary cartridge 10*c* with the booster cartridge 102*a*, shell 10 is also modified in comparison to that depicted in FIG. 1 by the incorporation of a recess 114 to receive the extension 112 of secondary cartridge 102*a*. The recess 114 in the primary cartridge 10*c* is of the same form and configuration as that described and depicted in relation to the secondary cartridges 102 and is closed by a disc 122.

Now that embodiments of the present invention have been described in detail it will be apparent to those skilled in the relevant art that numerous modification and variations may be made without departing from the basic inventive concepts. For example in the method depicted by FIGS. 12 and 13, instead of mechanically holding the stemming 52 within the hole 56 by use of an acrow prop 66, different mechanical devices can be used such as for example, a weight or massive object, or placing say the bucket of an excavator over the collar 50. In a further variation, second end 18 of the shell 10 can be formed with a circumferential rebate 74 as depicted in FIG. 14 for seating one end of a sleeve or tube 76. The tube 76 is filled with the stemming material 52. Tube 76 ideally would be made from a thin walled easily frangible and/or pliable material such as paper, thin plastics, rubber or cardboard. Indeed the shell 10 could also be made of such materials. In this event the tube 76 and/or shell 10 can be radially expanded to press against the wall of hole 46 and eliminate any free volume within the hole when subjected to axial compression forces provided by the acrow prop 66 or other mechanical retention device. End 58 of stemming bar 56 can be press fit into the opposite end of the tube 76 to allow one step insertion of the cartridge 10*c*, stemming material 52 and stemming bar.

Also, end 58 of the stemming bar can be formed with a point, taper or wedge-like member 78 as shown in phantom in FIGS. 12 and 13 to assist in the radial spreading and compaction of the stemming material 52 against the sides of the hole 46 thereby increasing the sealing effect.

Figure 16:
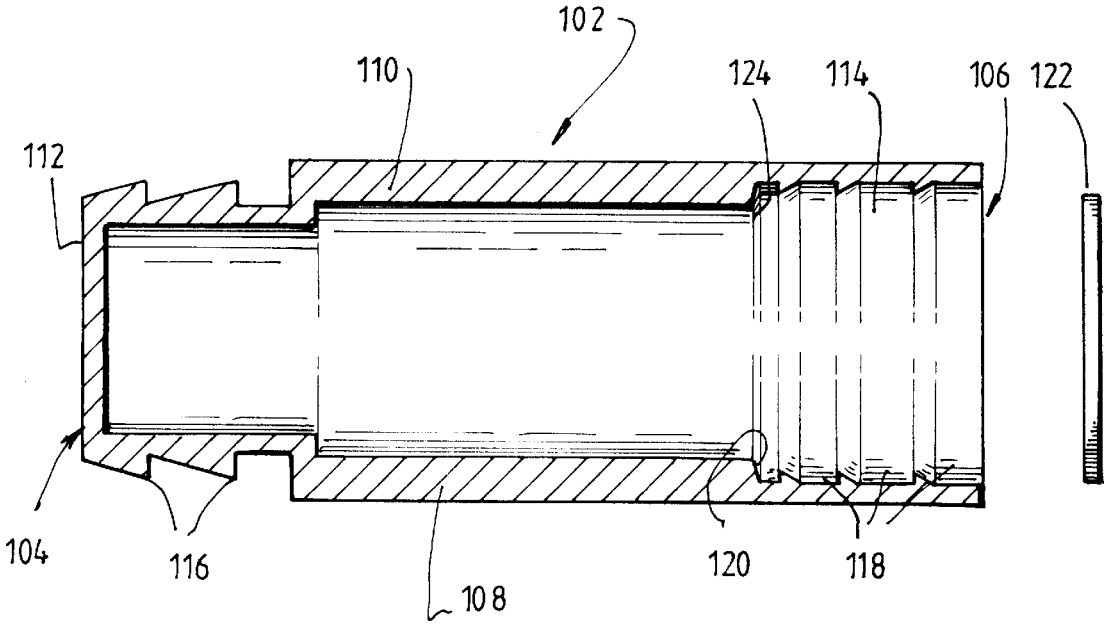
FIG. 16 is a cross-sectional view of a secondary cartridge of FIGS. 14 and 15.
Figure 17:
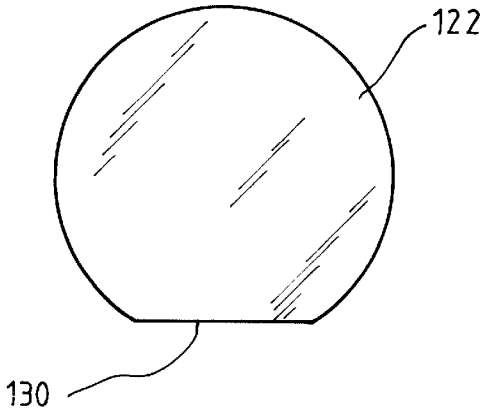
FIG. 17 is a plan view of a closure disc incorporated in the shell/cartridge shown in FIGS. 14 and 15.

With reference to the embodiment shown in FIGS. 14–16, as an alternative to the snap type fit between the primary cartridge 10*c* and secondary cartridges 102, other types of couplings can be used. For example, in the simplest form, the axial extension 112 and recesses 114 can be relatively configured to provide an interference fit. In other alternatives, complimentary screw threads can be formed on the outer surface of the extension 112 and the inner surface of the recess 114. In yet a further variation, a bayonet type coupling can be provided.

In addition, the closure discs 122 can be replaced by a frangible and/or combustible webs.

In addition, it is possible for the closure disc 122 or web to be placed at the end of shell 108 distant the axial extension 112. In order to then allow for engagement of an adjacent cartridge 102, the cartridges 102 will be filled with a quantity of energetic material less than their volume providing an air space to accommodate the inserted axial extension 112.

Also, in FIG. 14, a single electric match 32 is shown at the end of lead 34 for insertion into the end cap 28. However, it is possible for multiple electric matches or other initiators to be incorporated. For example, one or more additional electric matches can be coupled with a lead 34 via branch leads and sandwiched between the closure disc 122 and axial extension 112 of adjacent coupled primary shell and secondary shell, or to adjacent coupled secondary shells.

All such modifications and variations are deemed to be within the scope of the present invention the nature of which is to be determined from the above description and the appended claims.

The claims defining the invention are as follows:

1. A cartridge shell for use in fracturing in situ hard materials said shell being configured to be received in a hole in said in situ hard material and comprising at least; a main body defining a volume for holding an energetic material, the body having a first and second opposite ends, the first end being generally planar and the second end being tapered to form a point or wedge-like member directed away from the first end.

2. The cartridge shell according to claim 1 wherein the main body includes a line or zone of weakness adjacent to the first end.

3. The cartridge shell according to claim 2 further including a closure device at the first end said closure device being provided with, or in conjunction with the main body, defining the line or zone of weakness.

4. The cartridge shell according to claim 3 wherein the main body is provided with an opening at the first end and the closure device comprises a cap for closing said opening.

5. The cartridge shell according to claim 4 further including an aperture at the first end through which an initiator lead passes.

6. The cartridge shell according to claim 5 wherein the aperture is formed in the closure device.

7. The cartridge shell according to claim 5 wherein the cartridge shell includes a recess passageway on an outer surface about the first end to seat the initiator lead.

8. The cartridge shell according to claim 1 further including an aperture in or near the second end through which an initiator lead passes.

9. The cartridge shell according to claim 8 further including an internal recess or passageway through which the initiator lead extends.

10. The cartridge shell according to claim 1 wherein the second end is provided with two or more inclined surfaces that converge toward each other in the direction of the first end to the second end.

11. The cartridge shell according to claim 1 wherein the second end is in the form of conical frustum.

12. A shell for a cartridge for use in breaking and/or fracturing of hard material by the insertion of the cartridge followed by particulate stemming material in a hole in said hard material and subsequent initiation of the cartridge, the shell including at least a main body defining a volume for holding an energetic material, the body having first and second opposite ends, the second end including a surface for exerting a radial compressive force on the stemming material in use.

13. The cartridge shell according to claim 12 wherein the main body includes a line or zone of weakness adjacent to the first end.

14. A cartridge, for use in fracturing a hard-material, the cartridge comprising at least:

a cartridge shell in accordance with claim 1 and a quantity of an energetic material held within the main body of the cartridge shell.

15. A cartridge, for use in fracturing a hard material, the cartridge comprising at least:

a cartridge shell in accordance with claim 12 and a quantity of an energetic material held within the main body of the cartridge shell.

16. The cartridge according to claim 14 further including an initiator disposed within the main body.

17. The cartridge according to claim 14 wherein the energetic material is a propellant.

18. The cartridge according to claim 14 wherein the energetic material is a propellant.

19. A method of stemming a blast hole in a hard material, the blast hole having a collar adjacent a free face of the hard material and a toe at the opposite end of the hole, the method comprising at least the steps of:

inserting a cartridge in accordance with claim 14 into the blast hole with the second end of the cartridge facing the collar of the blast hole;

providing a particulate stemming material comprising a mixture of a dry binding agent, fines and coarse material;

depositing said stemming material into said hole;

mechanically holding the stemming in the hole.

20. A cartridge for use in fracturing an in situ hard material, said cartridge being configured to be received in a hole in said in situ hard material and including:

a shell, an initiator, and a quantity of propellant;

said shell having:

a main cylindrical body, a cap having a tubular portion open at one end and closed at an opposite end, said tubular portion inserted into said main body at a first end of said shell with said one end disposed inwardly of said opposite end, a tapered member attached to said main body and spaced from said cap, said tapered member narrowing in a direction along said main body away from said first end to said second end, and a volume defined within said main body between said cap and said tapered member;

said quantity of propellant held within said volume;

said initiator disposed in said propellant and provided with a lead which passes through a hole formed in one of said tapered member and said cap.

21. The cartridge according to claim 20, wherein said tapered member is juxtaposed relative to an end of said shell distant said cap whereby, in use, when said cartridge is disposed in a hole formed in said hard material with said tapered member facing a collar of said hole and said hole is stemmed with a particulate stemming material, a quantity of said particulate stemming material can be contained between an outer surface of said tapered member and an inside surface of said shell.

22. The cartridge according to claim 20 wherein said tapered member includes two planar surfaces which are inclined toward each other and terminate in a common straight edge.

23. The cartridge according to claim 22 wherein said surfaces are inclined at substantially the same angle relative to a central longitudinal axis of said shell.

24. The cartridge according to claim 20 wherein said shell, between a point where said tapered member commences to narrow and said closure cap, has a constant outside diameter.

25. A cartridge for use in breaking or fracturing an in situ hard material by the insertion of said cartridge followed by a particulate stemming material in a hole formed in the in situ hard material, said cartridge being configured to be received in said hole in said in situ hard material and including a shell, an initiator and a quantity of propellant, said shell having a main body, and first and second ends with a volume being defined within said main body between said first and second ends and containing said quantity of propellant, said second end of said shell including a surface for exerting a radial compressive force on said particulate stemming material when said propellant is ignited; said initiator disposed in said propellant and provided with a lead which passes through a hole formed either in said surface or through said first end.

26. The cartridge according to claim 25, wherein said surface is the surface of a member which narrows in a direction along said main body away from said first end.

27. The cartridge according to claim 26 wherein said shell, for a length between a point where the surface of said member commences to narrow and said first end, has a constant outer diameter.

28. The cartridge according to claim 26, wherein said member is formed separately of said main body and attached to said main body.

29. The cartridge according to claim 25, wherein said surface is composed of first and second planar surfaces which are inclined toward each other in a direction along said main body from said first end.

30. A system for fracturing an in situ hard material, comprising:

a plurality of holes in said in situ hard material;

a plurality of cartridge shells in accordance with claim 1 inserted in said plurality of holes; and a stemming material being located between an opening of each hole and a respective cartridge shell positioned in the hole.

31. The system of claim 30, wherein each of said plurality of cartridge shells is static in said holes before initiation.

32. A method of stemming a blast hole in a hard material, the blast hole having a collar adjacent a free face of the hard material and a toe at the opposite end of the hole, the method comprising at least the steps of:

inserting a cartridge shell in accordance with claim 12 into the blast hole with the second end of the cartridge shell facing the collar of the blast hole;

providing a particulate stemming material comprising a mixture of a dry binding agent, fines and, coarse material;

depositing said stemming material into said hole;

mechanically holding the stemming in the hole.

33. A system for fracturing an in situ hard material, comprising:

a plurality of holes in said in situ hard material;

a plurality of cartridge shells in accordance with claim 12 inserted in said plurality of holes; and a stemming material being located between an opening of each hole and a respective cartridge shell positioned in the hole.

34. The system of claim 33, wherein each of said plurality of cartridge shells is static in said holes before initiation.

35. A system for fracturing an in situ hard material, comprising:

a plurality of holes in said in situ hard material;

a plurality of cartridge shells in accordance with claim 20 inserted in said plurality of holes; and a stemming material being located between an opening of each hole and a respective cartridge shell positioned in the hole.

36. The system of claim 35, wherein each of said plurality of cartridge shells is static in said holes before initiation.

37. A method of stemming a blast hole in a hard material, the blast hole having a collar adjacent a free face of the hard material and a toe at the opposite end of the hole, the method comprising at least the steps of:

inserting a cartridge shell in accordance with claim 20 into the blast hole with the second end of the cartridge shell facing the collar of the blast hole;

providing a particulate stemming material comprising a mixture of a dry binding agent, fines and coarse material;

depositing said stemming material into said hole;

mechanically holding the stemming in the hole.

38. A system for fracturing an in situ hard material, comprising:

a plurality of holes in said in situ hard material;

a plurality of cartridge shells in accordance with claim 25 inserted in said plurality of holes; and a stemming material being located between an opening of each hole and a respective cartridge shell positioned in the hole.

39. The system of claim 38, wherein each of said plurality of cartridge shells is static in said holes before initiation.

40. A method of stemming a blast hole in a hard material, the blast hole having a collar adjacent a free face of the hard material and a toe at the opposite end of the hole, the method comprising at least the steps of:

inserting a cartridge shell in accordance with claim 25 into the blast hole with the second end of the cartridge shell facing the collar of the blast hole;

providing a particulate stemming material comprising a mixture of a dry binding agent, fines and coarse material;

depositing said stemming material into said hole;

mechanically holding the stemming in the hole.

* * * * *